United States Patent [19]

Friedli et al.

[11] 4,332,660

[45] Jun. 1, 1982

[54] STORAGE BUNKER DEVICE FOR FEEDING ELECTROLYTIC CELL

[75] Inventors: Hans Friedli, Steg; Erwin Arnold, Venthôme, both of Switzerland

[73] Assignee: Swiss Aluminium Ltd., Chippis, Switzerland

[21] Appl. No.: 184,344

[22] Filed: Sep. 5, 1980

[30] Foreign Application Priority Data

Sep. 10, 1979 [CH] Switzerland ..... 8147/79

[51] Int. Cl.[3] ..... C25C 3/14

[52] U.S. Cl. ..... 204/245; 204/67

[58] Field of Search ..... 204/67, 243 R-247; 222/136, 137, 132

[56] References Cited

U.S. PATENT DOCUMENTS

| | | | |
|---|---|---|---|
| 3,006,825 | 10/1961 | Sem | 204/245 X |
| 3,141,575 | 7/1964 | Brewer | 222/136 X |
| 3,604,057 | 9/1971 | Nixdorff, Jr. | 222/137 X |
| 3,616,440 | 10/1971 | Forberg | 204/245 |
| 3,664,935 | 5/1972 | Johnson | 204/245 X |
| 3,681,229 | 8/1972 | Lowe | 204/245 X |
| 3,797,702 | 3/1974 | Robertson | 222/136 X |
| 3,839,167 | 10/1974 | Sleppy | 204/245 X |
| 4,016,053 | 4/1977 | Stankovich et al. | 204/245 X |

FOREIGN PATENT DOCUMENTS

| | | | |
|---|---|---|---|
| 49-29804 | 8/1974 | Japan | 204/245 |
| 549512 | 5/1977 | U.S.S.R. | 204/245 |

*Primary Examiner*—Delbert E. Gantz
*Assistant Examiner*—Donald R. Valentine
*Attorney, Agent, or Firm*—Bachman and LaPointe

[57] ABSTRACT

The invention relates to a storage bunker for a facility which breaks open the solidified crust on an electrolytic cell. The bunker is subdivided into a large container for alumina and a small container for additives. Below the containers are provided a closing-off plate, a dosing facility and a common outlet pipe leading to the break in the crust. When additives are required, these can be fed directly to the small container via the pipe line for supplying alumina. These are then fed to the cell in measured amounts, if desired, mixed with alumina.

8 Claims, 2 Drawing Figures

30
32
14
18
16
10
12
28
20
22
24
26
34

STORAGE BUNKER DEVICE FOR FEEDING ELECTROLYTIC CELL

BACKGROUND OF THE INVENTION

The invention relates to a storage bunker, containing alumina and other additives, for a crust breaking facility which is used to break the solidified crust on an electrolytic cell, in particular on a cell for producing aluminum.

In the manufacture of aluminum from aluminum oxide the latter is dissolved in a fluoride melt made up for the greater part of cryolite. The aluminum which separates out at the cathode collects under the fluoride melt on the carbon floor of the cell; the surface of this liquid aluminum acts as the cathode. Dipping into the melt from above are anodes which, in the conventional reduction process, are made of amorphous carbon. As a result of the electrolytic decomposition of the aluminum oxide, oxygen is produced at the carbon anodes; this oxygen combines with the carbon in the anodes to form $CO_2$ and CO. The electrolytic process takes place in a temperature range of approximately 940°–970° C.

The concentration of aluminum oxide decreases in the course of the process. At an $Al_2O_3$ concentration of 1–2 wt.% the so-called anode effect occurs producing an increase in voltage from e.g. 4–4.5 V to 30 V and more. At this time at the latest the crust must be broken open and the concentration of aluminum oxide increased by adding more alumina to the cell.

Under normal operating conditions the cell is fed with aluminum oxide regularly, even when no anode effect occurs. Also, whenever the anode effect occurs the crust must be broken open and the alumina concentration increased by the addition of more aluminum oxide, which is called servicing the cell.

For many years now servicing the cell includes breaking open the crust of solidified melt between the anodes and the side ledge of the cell, and then adding fresh aluminum oxide. This process which is still widely practiced today is finding increasing criticism because of the pollution of the air in the pot room and the air outside. In recent years therefore it has become increasingly necessary and obligatory to hood over or encapsulate the reduction cells and to treat the exhaust gases. It is however not possible to capture completely all the exhaust gases by hooding the cells if the cells are serviced in the classical manner between the anodes and the side ledge of the cells.

More recently therefore aluminum producers have been going over to servicing at the longitudinal axis of the cell. After breaking open the crust, the alumina is fed to the cell either locally and continuously according to the point feeder principle or discontinuously along the whole of the central axis of the cell. In both cases a storage bunker for alumina is provided above the cell. The same applies for the transverse cell feeding proposed recently by the applicant (U.S. Pat. No. 4,172,018).

The known types of storage bunker or alumina silo on electrolytic cells are in the form of tapered funnels or containers with a tapered funnel in the lower part. The contents of the container or containers on the cell usually suffice for 1–2 days supply to the cell.

During the process of electrolysis the molten electrolyte becomes depleted not only in alumina but also in other additives such as cryolite and/or aluminum fluoride i.e. fluxing agents. In this case there are three ways which are known to supply the bath with the necessary additives:

The hooding over the cell is opened up and the additives fed manually or by means of a mobile servicing device when the crust is broken open.

The additives are fed to the storage bunker via the supply line for the alumina.

The additives are fed in a separate supply line to a hollow housing above the chisel of the crust breaker, from which they can be supplied to the bath (German Pat. No. 2,135,485).

However, all the known facilities for supplying additives to the cells exhibit disadvantages:

Each time the hooding over the cell is opened up fumes escape to the atmosphere in the pot room, which causes a deterioration in the working conditions in the pot room.

If the additives are fed in a closed system into a storage bunker, then there can be a delay of up to a day or more before they reach the bath. This means it is not possible to ensure optimum operation of the cell.

The arrangement using separate supply lines, pressurized containers, feeding devices and run outs requires much greater financial investment and technical effort.

It is therefore the principal object of the present invention to provide a storage bunker for a crust breaking facility which is used to break the solidified crust on an electrolytic cell, and a process for supplying alumina, such that additives can be fed to the cell in a closed system without any significant additional costs and without the additives being delayed on route.

SUMMARY OF THE INVENTION

The foregoing object is achieved by way of the present invention wherein a storage bunker is subdivided into a large container for alumina and a small container for the additives, and that, provided below the containers there is a sliding plate for shutting off the supply from the bunker, a dosing facility and a common outlet pipe leading to the break made in the crust.

Usefully the supply line, fed with alumina and/or additives from the pressurized container, divides into two channels shortly before or immediately after it enters the storage bunker, which is covered with a top sheet. One end of the branched supply line terminates above the large container for the alumina, and is provided with a plurality of outlets. The other end of the branched supply line terminates above the small container for the additives and is, depending on the dimensions of this small container, provided with one or more outlets. Both end pieces of the supply line are, usefully, in a horizontal plane. At the branching of the supply line, or shortly after it, suitable means for diverting or blocking the material fed along the line are provided. These permit:

(a) The material supplied to flow through both end pieces into both containers.

(b) The material supplied to flow through one end piece into the large or the small container.

(c) Both end pieces to be closed off to prevent flow of material.

According to another embodiment of the present invention an end of a supply line for delivering alumina or additives to the bunker is provided in the upper region of the bunker which is fitted with a cover sheet, whereby the said end piece features a plurality of outlets. The small container for the additives lies directly under the last (in the direction of flow) of the outlets in the pipe supplying alumina. Means of diverting or blocking off the flow of material are provided in the branched part of the supply pipe or in the outlets.

Particularly suitable in all versions is the use of lengths of pipe with compressed air feeding and pipe branching such as are described in the Swiss Patent Appl. No. 7854/79. In this case at least a part of the facilities for diverting or blocking the material in the pipeline can be replaced by such in the compressed air pipeline.

The volume of the smaller container is preferably between 0.5 and 25 vol.%, preferably 5–20 vol.%, of the total volume of the storage bunker.

According to a first version of the storage bunker the large and the small containers are separated by a substantially vertical dividing wall which can be removed.

According to a second version the small bunker is tube-shaped. This tube-shaped container can be positioned vertically or at a slight angle in the storage bunker. This has the following advantages:

(a) Position in silo not limited.
(b) Better use of space.
(c) Height can be varied; the mixing ratio can be adjusted by raising the tube.

The process is controlled via a central electronic data processing unit which also activates and controls the supply of additives, preferably in the pressure vessel used for the supply of alumina. However, the additives can also be fed into a much smaller pressure vessel which connects up to the alumina supply line.

The additives dissolve better in the molten electrolyte if they are not added directly, but if already mixed with alumina, for example in a ratio of 2 parts additives to one part alumina.

BRIEF DESCRIPTION OF THE DRAWINGS

Exemplified embodiments of the invention are described hereinbelow with the help of the following schematic drawings wherein.

DETAILED DESCRIPTION

Figures 1, 2:
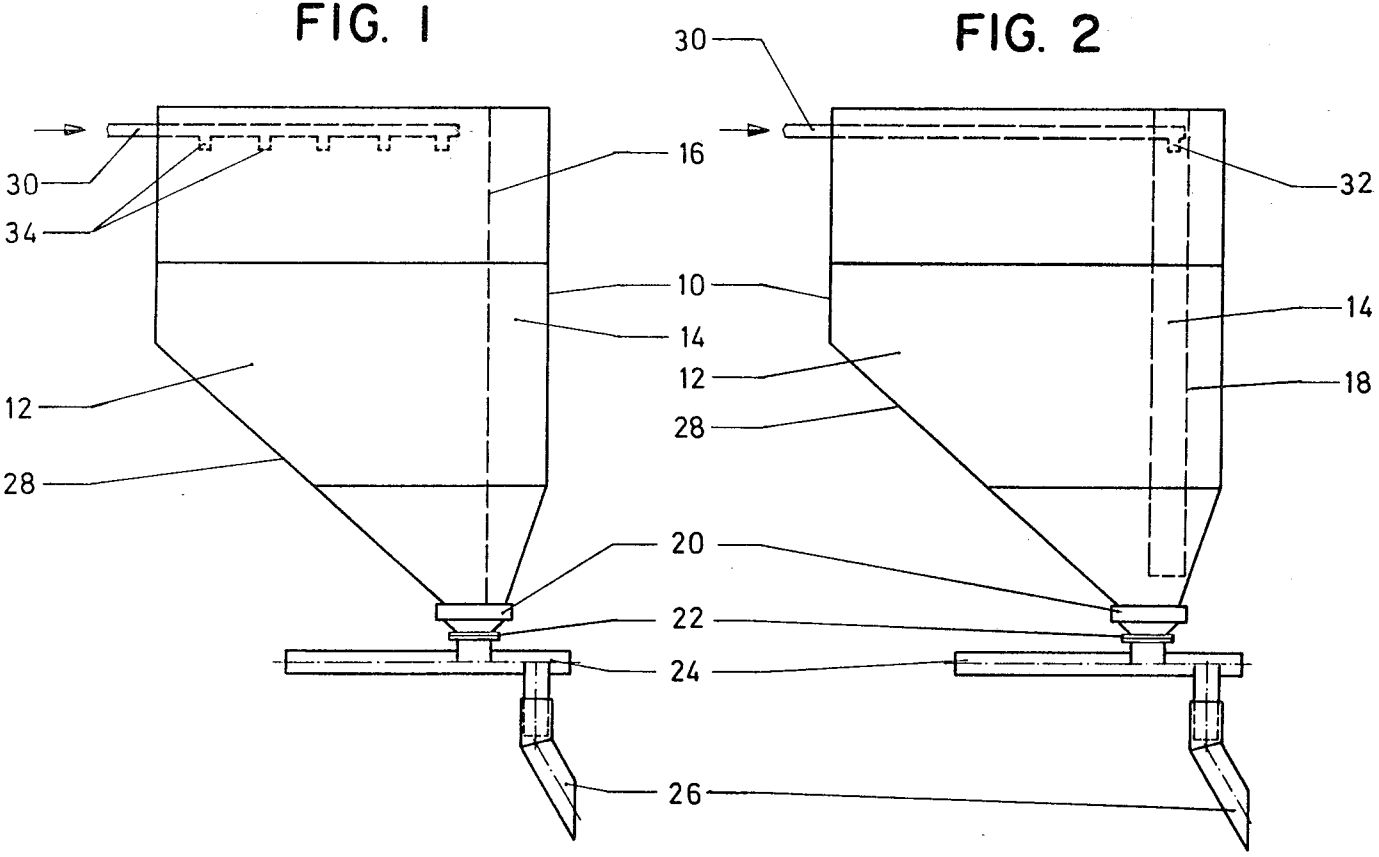
FIG. 1: Is a view of a feeding device with a vertical, flat dividing wall in the storage bunker.
FIG. 2: Is a view of a feeding device with a tube-shaped small container in the storage bunker.

FIG. 1 shows a storage bunker 10 with a large container 12 for the alumina and a small container 14 for the additives such as cryolite, aluminum fluoride and crushed electrolyte crust. The two containers are separated by a vertical dividing wall 16. The closing-off plate 20 which delimits the bunker at the bottom can be in one or two parts. A two-piece plate 20 in the plane of the sidewall can be employed as a mixer in that both halves of the plate can be pulled out different distances according to the ratio of the mixture desired.

Fitted to the bottom of the bunker is a flange 22 which is connected to a closing facility 24. This facility 24 is in the form e.g. of one of the closing facilities described in the U.S. Appl. Ser. No. 124,598 as an alumina drawer or slide. In a space of limited size a certain amount of alumina or additives e.g. 1 kg is pushed by each stroke of a piston arrangement into the outlet pipe 26. The ejected material falls through the inclined part of the outlet pipe onto the place in the crust broken open by the chisel.

In the upper part of the bunker an end piece of the supply line 30 from the pressurized vessel to the storage bunker 10 is shown. The outlets 34 from this end piece are all directed into the large container for the alumina. The other end piece, on the same horizontal plane, the outlet 32 from which is directed into the small container 14, is shown in FIG. 2 where the end piece over the large container has been omitted.

The alumina bunker 10 in FIG. 2 differs from FIG. 1 also in terms of supply and removal of alumina or additives but only with respect to the different kind of subdivision into a large container 12 and small container 14. This small container is delimited by a tube wall 18. The last outlet 32 in the supply pipe 30 is situated above the tube-shaped container 14. A given, required ratio of alumina to additives can be achieved not only by means of a two-piece closing plate 20, but also by raising the tube 14.

If the electrolyte becomes depleted in additives and e.g. becomes alkaline or too acidic, and both containers are full of alumina, then the plate 20 is set such that only alumina from the small container is allowed to flow out. The end of the pipe with outlets 34 for supplying alumina is closed, the necessary additives introduced into the pressurized container, and fed to the small container 14 via the feed pipe 30 and outlet 32. The additives and, if desired, some alumina are then fed to the cell via the plate 20, which is opened for the small container, and then through the dosing/measuring device 24 and the outlet pipe 26. This method of operating is, however, useful, only when the volume of the small container is small compared with that of the large container, otherwise much time is lost before the chamber has been emptied.

When charging with alumina, therefore, the outlets 32 or the inlet to the small container 14 can be closed so that all the alumina enters the large container 12. The small container remains empty and can be used quickly any time additives have to be fed to the bath.

The wall 28 must be so inclined that the poorest flowing material will flow off it.

In all versions of the storage bunker process steps involved in feeding alumina and additives, setting the plate 20 and operating the dosing/measuring device 24 are preferably activated and controlled by means of a central electronic data processing unit.

It is to be understood that the invention is not limited to the illustrations described and shown herein, which are deemed to be merely illustrative of the best modes of carrying out the invention, and which are susceptible of modification of form, size, arrangement of parts and details of operation. The invention rather is intended to encompass all such modifications which are within its spirit and scope as defined by the claims.

What is claimed is:

1. A device for feeding alumina and additives to an electrolytic cell comprising:

a storage bunker having a material inlet and a material outlet, said storage bunker having a first compartment for at least said alumina, a second compartment for at least said additives and dividing means movable in the vertical direction for dividing said first compartment from said second compartment;

an outlet pipe downstream of said material outlet for feeding alumina and additives to said cell; and a dosing device positioned between said material outlet and said outlet pipe for feeding material to said outlet pipe.

2. A device according to claim 1 wherein said dividing means comprises a substantially flat vertical wall.

3. A device according to claim 1 wherein said dividing means comprises a pipe positioned in said storage bunker, said pipe defining said second compartment.

4. A device according to claim 1 wherein said material inlet comprises an inlet pipe having a first branch portion provided with a plurality of outlets for feeding material to said first compartment and a second branch portion provided with at least one outlet for feeding material to said second compartment.

5. A device according to claim 1 wherein said material inlet comprises an inlet pipe having a plurality of serially arranged outlets wherein at least the last outlet feeds material to said second compartment.

6. A device according to claim 1 wherein said first compartment is larger than said second compartment.

7. A device according to claim 6 wherein the volume of said second compartment is from about 0.5–25% the total volume of said storage bunker.

8. A device according to claim 6 wherein the volume of said second compartment is from about 5–20% the total volume of said storage bunker.

* * * * *